United States Patent [19]

Jedick

[11] Patent Number: 4,840,431

[45] Date of Patent: Jun. 20, 1989

[54] PORTABLE ROTARY POWER SAW

[75] Inventor: Andrew L. Jedick, Sheffield, Ohio

[73] Assignee: Diamond Products, Inc., Elyria, Ohio

[21] Appl. No.: 224,452

[22] Filed: Jul. 26, 1988

[51] Int. Cl.[4] ..... E21C 47/00

[52] U.S. Cl. ..... 299/39; 125/14

[58] Field of Search ..... 299/39; 125/14

[56] References Cited

U.S. PATENT DOCUMENTS

| | | | |
|---|---|---|---|
| 433,953 | 8/1890 | Moody | 299/27 |
| 932,591 | 3/1909 | Smith | 299/27 |
| 1,106,225 | 8/1914 | Kreeger | 299/27 |
| 2,468,336 | 4/1949 | Lewis | 299/39 |
| 2,569,682 | 6/1951 | Lewis | 299/39 |
| 2,673,725 | 3/1954 | Coates | 299/39 |
| 2,736,311 | 2/1956 | Coates | 125/14 |
| 3,301,601 | 1/1967 | Zuzelo | 299/39 |
| 3,663,060 | 5/1972 | Shatwell et al. | 299/39 |
| 3,747,981 | 7/1973 | Zuzelo | 299/39 |
| 4,175,788 | 11/1979 | Jacobson et al. | 299/1 |

FOREIGN PATENT DOCUMENTS

| | | | |
|---|---|---|---|
| 2155524 | 9/1985 | United Kingdom | 299/39 |

OTHER PUBLICATIONS

Materials concerning Christensen Concrete & Asphalt Saw C—84, (1983).

*Primary Examiner*—Jerome W. Massie, IV

*Assistant Examiner*—Gay Ann Spahn

*Attorney, Agent, or Firm*—Calfee, Halter & Griswold

[57] ABSTRACT

A portable rotary power saw comprising a housing having mounted at its aft end a pair of rear wheels and a handlebar assembly. Mounted at the fore end of the housing a rotary cutting blade and a vertically adjustable axle having a pair of front wheels. Located between the rear and front wheels within the housing is a stationary axle mounted upon a pair of bearings which permit the axle to pivot. The saw includes a height adjustment mechanism comprising a segment, a latch, and a cable and lever assembly for operating the latch. One leg of the segment is supported by the stationary axle and connected to the adjustable axle by a pair of arms. The other leg of the segment includes a plurality of notches spaced along its length and it extends through the top of the housing. The latch is located on top of the housing immediately adjacent the notched leg and is capable of pivoting in and out of engagement with the notches. The segment is biased such that when a user squeezes the lver and exerts a vertically downward force upon the handlebar assembly, the adjustable axle extends vertically downward relative to the housing. Alternatively, when the user discontinues squeezing the lever, the latch engages one of the notches of the segment thereby locking the segment and the adjustable axle into a predetermined position.

13 Claims, 5 Drawing Sheets

PORTABLE ROTARY POWER SAW

DISCLOSURE OF THE INVENTION

This invention relates to a portable power tool. More particularly, the present invention relates to a portable rotary power saw for cutting a groove into concrete, asphalt, or other like surfaces.

BACKGROUND

The prior art provides various portable saws for cutting grooves into surfaces such as concrete and asphalt. Examples of such prior art saws may be found in Zuzelo U.S. Pat. No. 3,747,981 and Shatwell, et al. U.S. Pat. No. 3,663,060. Unfortunately, such prior art saws display some disadvantages. More particularly, prior art saws such as that disclosed by Shatwell, et al. require that the power source or engine which is used to drive the rotary saw blade be vertically adjusted or moved relative to the housing or frame of the saw in order to effectuate a change in the cutting depth of the saw blade. Also, saws such as that disclosed by Shatwell, et al. utilize lever assemblies which can be quite difficult and awkward for a user to operate. More particularly, some of the lever assemblies require the user to remove one or more hands from the handgrips of the saw in order to operate the lever assembly.

Prior art saws, such as that disclosed by Zuzelo, also display some disadvantages for they employ handwheels which are mounted upon threaded rods for adjusting the vertical height of the saw blade. In order to effectuate a significant vertical adjustment of the saw blade, a considerable amount of the user's time can be required to rotate the handwheel. Additionally, such saws generally require the user to remove one or more hands from the handgrips of the saw in order to rotate the handwheel.

Because many of the prior art saws are difficult to height adjust, many times a user, upon completion of a cut, will merely tilt the saw back on its rear wheels and move the saw about on its rear wheels instead of using the height adjustment mechanism to raise and lower the blade. While tilting the saw back, the user many times tilts the saw back much more than that which is necessary to clear the blade from the cutting surface. When an internal combustion engine is employed to drive the saw blade, this excessive tilting resulting in the substantial displacement of the oil within the engine. The substantial displacement of the oil leads to the improper internal oiling of the engine parts and thus a shortened service life for the engine.

SUMMARY OF THE INVENTION

The present invention provides a portable rotary power saw having a height adjustment mechanism which serves to overcome some of the disadvantages associated with the prior art portable rotary power saws. More particularly, the present invention provides a saw that allows a user to adjust the cutting depth of the saw while a user's hands remain on the handgrips of the saw. The mechanism is easily operated by the user and it allows the saw blade to be quickly adjusted to the desired height. This quick and easy means of height adjustment encourages the user of the saw to employ the height adjustment mechanism instead of merely rocking the saw back on its rear wheels and moving it around only upon its rear wheels.

In a preferred embodiment the saw comprises a housing having mounted at its aft end a pair of rear wheels which support the aft end upon the cutting surface. The aft end also includes a handlebar assembly extending vertically upward from the top of the housing. The housing at its fore end includes a rotary cutting or saw blade and a vertically adjustable axle having a pair of front wheels. Located between the rear and front wheels is a stationary axle. The stationary axle is mounted within the housing upon a pair of bearings which permit it to pivot. The adjustable axle is connected to the stationary axle by a pair of arms. The adjustment mechanism includes an L-shaped segment, a latch and a cable and lever assembly for operating the latch. One leg of the segment is supported with a clevis upon the stationary axle. The other leg of the segment includes a plurality of notches spaced along its length and it extends through the top of the housing.

The latch is located immediately adjacent the notched leg on the top of the housing and is capable of pivoting in and out of engagement with the notches. Mounted in the immediate proximity of one of the handgrips of the handlebar assembly is the lever assembly. When a user squeezes the lever the cable assembly, which is connected to the lever and the latch, pivots the latch out of engagement from the notches of the segment. The segment is connected to the adjustable axle and is biased such that when a user squeezes the lever and exerts a vertically downward force upon the handlebar assembly, the segment, arms and adjustable axle pivot about the stationary axle and the adjustable axle extends vertically downward relative to the housing. Alternatively, when the user discontinues squeezing the lever, the latch engages one of the notches of the segment locking the segment, arms and the adjustable axle into a pre-determined position. Thus, when the latch engages one of the notches, the saw blade assumes a fixed vertical position relative to the cutting surface.

The saw blade is driven by an internal combustion engine mounted on the top of the housing. In order to facilitate the smooth operation of the height adjustment mechanism, the rear wheels are positioned at the aft end of the housing, well ahead of the center of gravity of the engine. Additionally, the stationary axle is positioned within the housing in the proximity of such center of gravity and the adjustable axle is positioned at the fore end of the housing, behind such center of gravity.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
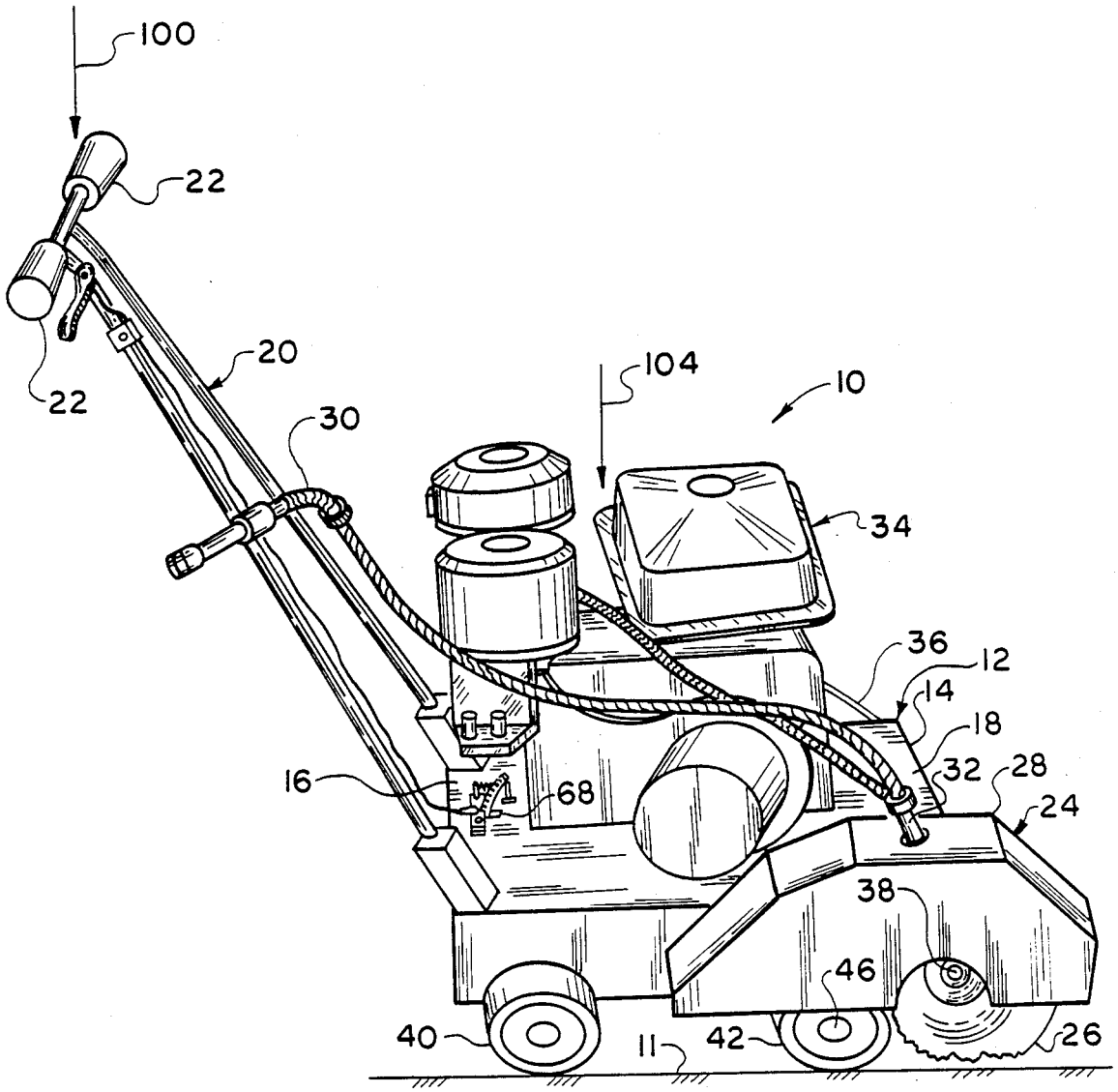
FIG. 1 is a schematic elevated perspective view of a portable rotary power saw made in accordance with the present invention.

Referring to the drawings, and initially to FIG. 1, there is illustrated a portable rotary power saw 10 made in accordance with the present invention. Saw 10 is designed to allow a user to cut grooves into surfaces 11 such as, for example, concrete, asphalt, wood or epoxy.

Saw 10 comprises a housing 12 having a fore end 14 and an aft end 16. Mounted at the aft end 16 on the top 18 of the housing 12 is a handlebar assembly 20. Handlebar assembly 20 includes at its distal end a pair of handgrips 22 upon which a user's hands are normally positioned during the operation of the saw 10.

Mounted at the fore end 14 of the housing 12 is a cutting assembly 24. Cutting assembly 24 includes a rotary cutting device or blade 26 (partially shown) partially enclosed by a protective shield 28. Mounted at the top of the protective shield 28 is a water supply line 30 and spray nozzle 32. Nozzle 32 serves to direct a flow of cooling and lubricating water upon the blade 26 thereby promoting the service life of the blade 26.

Mounted on the top 18 of the housing 12 intermediate the fore end 14 and aft end 16 is a power source 34. Although in the illustrated embodiment power source 34 comprises an internal combustion engine, it will be appreciated that this invention contemplates any one of a variety of power sources such as electric, air or hydraulic motor. Connecting the power source 34 to the blade 26 is a power transmission device 36. In the illustrated embodiment, the power transmission device comprises a V-belt that drives the axle 38 upon which the blade 26 is mounted.

In order to facilitate the portable movement of the saw 10 from one location to another by a user, there is provided a pair of wheels 40 in the immediate proximity of the aft end 16 of the housing 12 and a pair of wheels 42 in the proximity of the fore end 14 of the housing 12. Wheels 40 and 42 may comprise any one of a variety of commercially available wheels and such wheels may be mounted in various ways.

Figure 2:
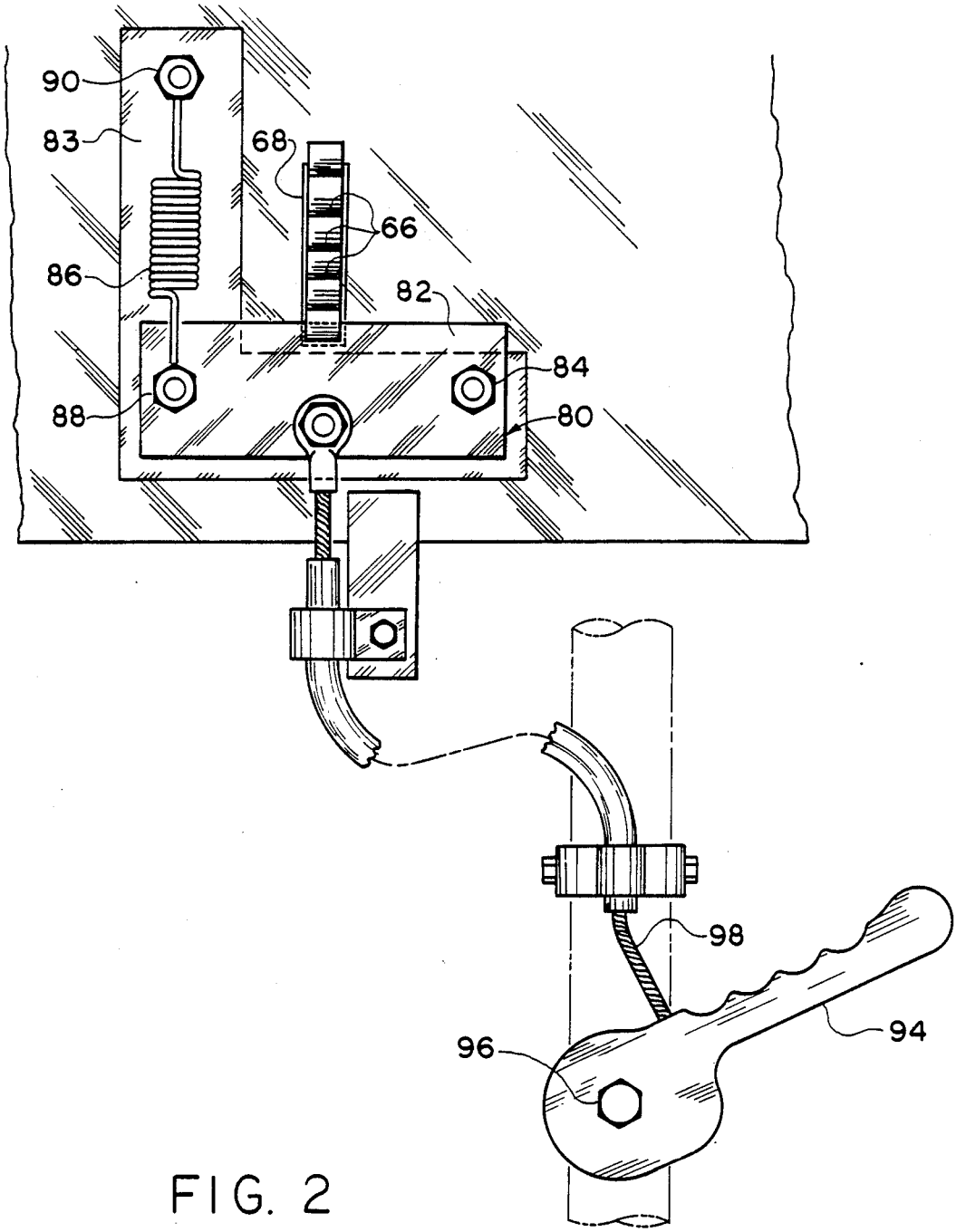
FIG. 2 is a fragmentary top plan view of the lever, cable and latch assemblies of the saw illustrated in FIG. 1 with the latch engaging the notches of the segment.
Figure 3:
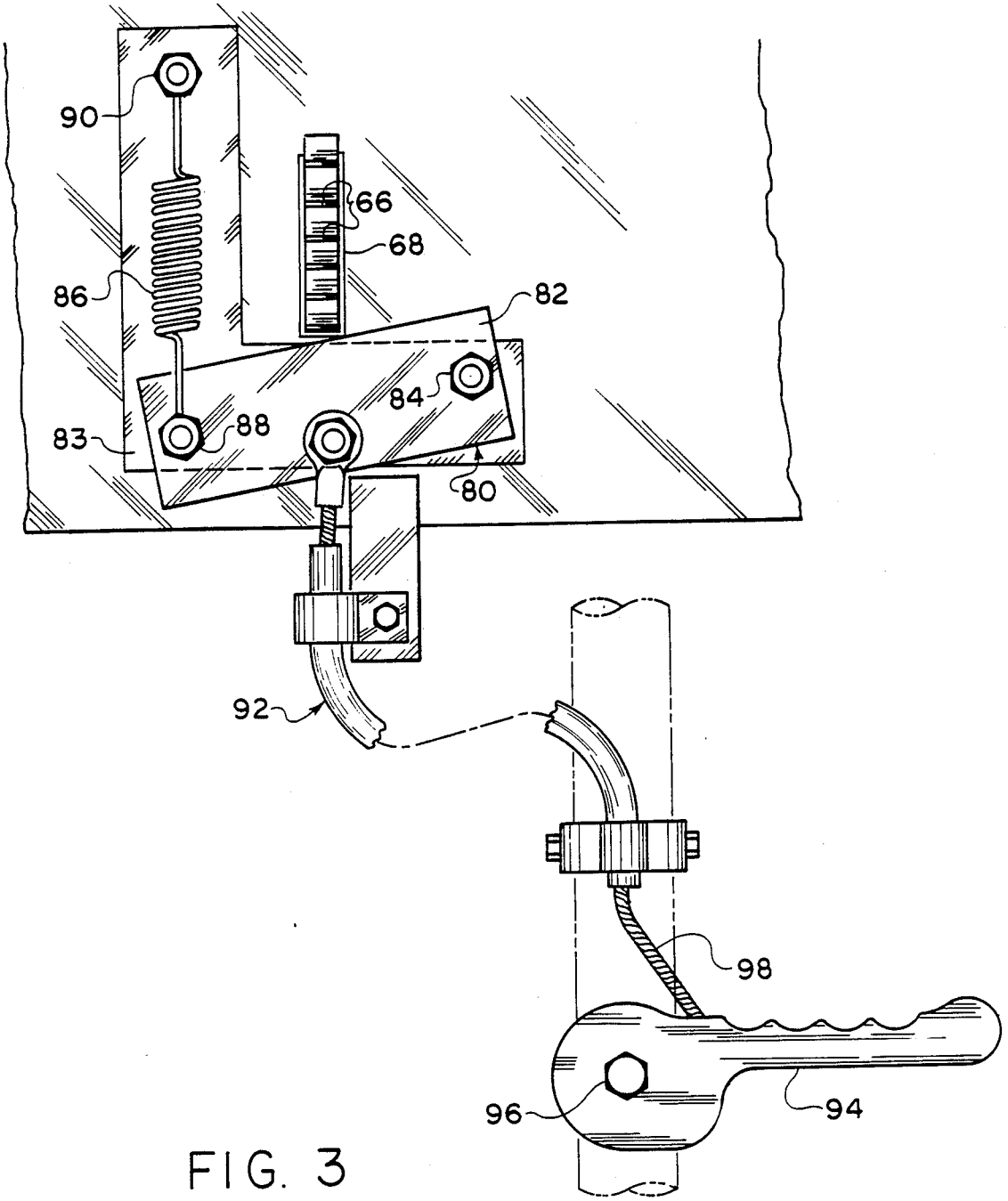
FIG. 3 is a fragmentary top plan view of the lever, cable and latch assemblies of the saw illustrated in FIG. 1 with the latch disengaged from the notches of the segment.
Figure 4:
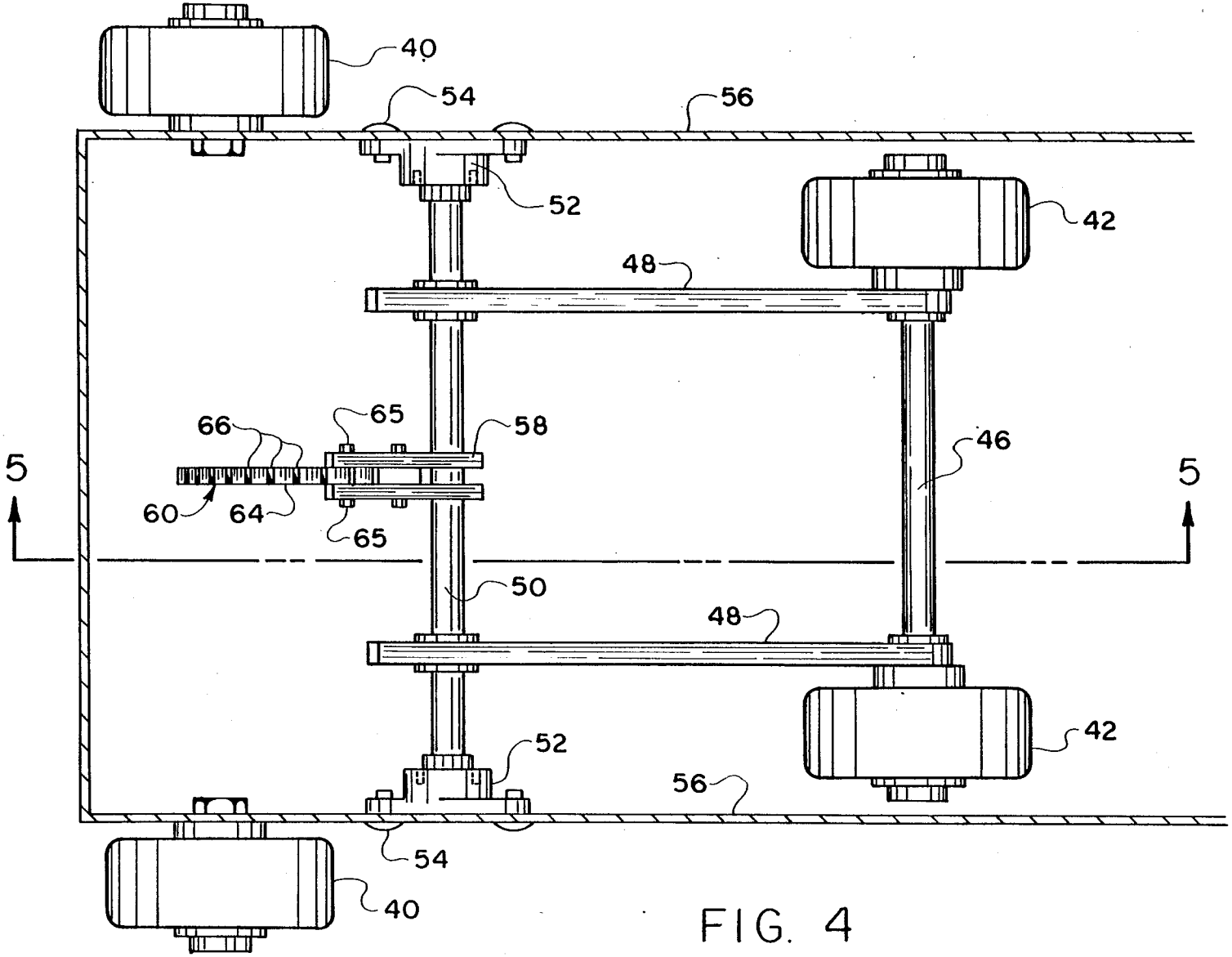
FIG. 4 is a fragmentary partially cross-sectioned top plan view taken just below the top of the housing of the saw illustrated in FIG. 1.

Referring now to FIGS. 2–5, the mechanism or means for adjusting the vertical height of the fore end 18 of the housing 12 and thus the position of the blade 26 relative to the surface 11 is more completely illustrated. More particularly, as shown in FIG. 4, wheels 42 are mounted for rotation upon a vertically adjustable axle 46. Supporting adjustable axle 46 are a pair of arms 48. Arms 48 are mounted with welds upon stationary axle 50. Stationary axle 50 is supported at its distal ends by bearings 52 which are mounted by fasteners 54 to the lateral sides 56 of the housing 12. Bearings 52 allow stationary axle 50 to pivot.

Figure 5:
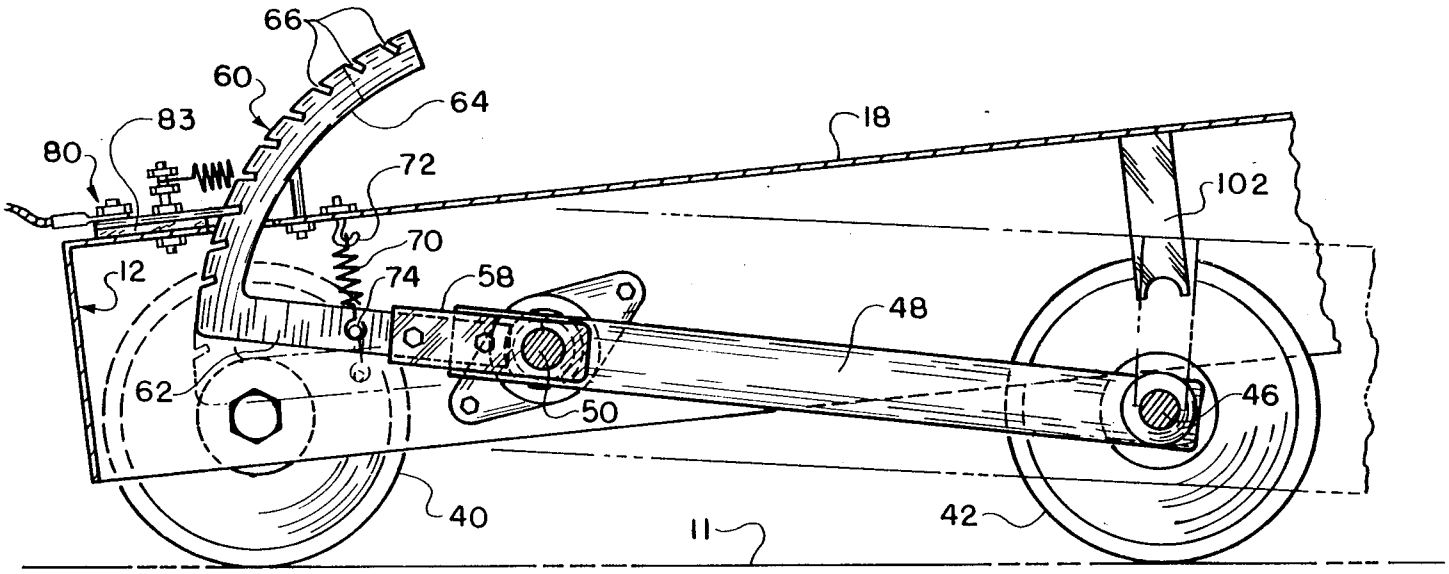
FIG. 5 is a fragmentary partially cross-sectioned view of the housing taken along line 5—5 of FIG. 4.

Attached by a weld to the center of the stationary axle 50 is a clevis 58. Attached to clevis 58 is an L-shaped segment 60. As shown in FIG. 5, segment 60 includes a straight leg 62 and a curved leg 64. Straight leg 62 is attached to clevis 58 by fasteners 65. Curved leg 64 is curved throughout its length to form an arc and it includes a plurality of grooves or notches 66.

Curved leg 64 extends above the top 18 of housing 12 through opening 68. Biasing segment 60, such that curved leg 64 is pulled or biased up through the top 18, is a spring 70. Spring 70 at one end is attached by a hooked fastener 72 to the top of housing 12. Spring 70 at its other end is secured by pin 74 to the straight leg 62 of segment 60. The position of the front wheels 42 relative to the housing 12, and thus the vertical height of the fore end 14 of the housing 12 and the blade 26 relative to the ground 11, is determined by the extent to which the curved leg 64 of the segment 60 extends through the top 18 of the housing 12. More particularly, as shown in FIG. 5, more of the curved leg 64 extends above the top 18 of housing 12 when arms 48 pivot forward (clockwise) upon stationary axle 50 raising the fore end 14 of the housing 12 above the ground 11 as compared to when the arms 48 extend substantially parallel to the top 18 of the housing 12 (as shown schematically in phantom).

Segment 60 is retained in position relative to the housing 12 by latch assembly 80. As shown in FIGS. 2 and 3, latch assembly 80 comprises a latch 82 which is mounted upon spacer 83 by fastener 84 in such a manner as to permit latch 82 to pivot in and out of engagement with notches 66. Latch 82 is biased in engagement with notches 66 by spring 86. Spring 86 is attached at one end by a fastener 88 to latch 82 and at the other end above the top 18 by fastener 90.

As shown in FIG. 3, latch 82 is moved out of engagement with notches 66 by cable assembly 92 and lever 94. Lever 94 is mounted for pivoting by fastener 96 in the immediate proximity of one of the handgrips 22 (as shown in FIG. 1) such that a user can easily grasp the lever 94 while the user's hand remains on the handgrip 22. More particularly, preferably lever 94 is not spaced more than about 4 inches from the outside diameter of the handgrip 22.

Cable 98 is connected at one end to the lever 94 and at the other end to the latch 82. As as shown in FIG. 2, when latch 82 is in engagement with notches 66, lever 94 is at about the one o'clock position. When lever 94 is grasped by the hand of a user and pivoted clockwise to about the three o'clock position, the motion of the lever 94 is transferred by the cable 98 to the latch 82 thereby stretching spring 86 and moving latch 82 out of engagement from notches 66 as shown in FIG. 3. Although the preferred embodiment employs a lever 94 and cable assembly 92, it will be appreciated that the present invention contemplates the user of similar devices or controllers which would allow a user to move the latch 82 in and out of engagement with the notches 66 while the user's hands remain on the handgrips 22. Such similar devices or controllers may include, for example, a twist grip mounted on one of the handgrips 22.

When a user wants to raise the fore end 14 of the saw 10 and thus decrease or eliminate altogether the cutting depth of the blade 26, such user merely has to squeeze lever 94 moving latch 92 out of engagement with grooves 66, and exert a downward force (as indicated by arrow 100 in FIG. 1) on handgrips 22. The downward force causes the housing 12 to pivot counterclockwise upon the rear wheels 40 located at the aft end 16 of housing 12. Simultaneously therewith, spring 70 causes arms 48 to pivot clockwise thereby lowering adjustable axle 46 relative to the fore end 14 of housing 12. Thus, blade 26 assumes a raised position relative to the ground or cutting surface 11. Releasing lever 94 allows latch 82 to pivot into engagement with grooves 66. Once latch 82 is in engagement, segment 60, arms 48 and adjustable axle 46 are securely locked into position thereby allowing blade 26 to assume a fixed position relative to the cutting surface.

When a user wants to lower the fore end 14 of the saw 10, such user merely has to squeeze or pull back lever 94. Simultaneously therewith the weight of the saw 10 causes the arms 48 to pivot counter-clockwise until adjustable axle 46 engages stop 102 thereby lowering the fore end 14 of the saw 10 and thus increasing the cutting depth of the blade 26. Of course, a user may lock the segment 60 and the adjustable axle 46 in position before the axle 46 engages the stop 102 by exerting a slight downward force on the handgrips 22, thereby counteracting the downward weight of the saw 10, and releasing the lever 94 before adjustable axle 46 engages the stop 102 mounted within the housing 12.

In order to facilitate the smooth and easy operation of the height adjustment mechanism, preferably wheels 40 are positioned, as illustrated, at the aft end 16 of the housing 12 well ahead of the approximate center of gravity 104 of the power source 34. Also preferably, as illustrated, the stationary axle 50 is located in the proximity of the center of gravity 104 and the adjustable axle 46 is located at the fore end 14 of the housing 12 well beyond the center of gravity 104.

Although in the illustrated embodiment the majority of the elements or parts are constructed of steel, it will be appreciated that the present invention contemplates the use of a variety of materials, including, for example, aluminum and plastics. Similarly, in addition to using fasteners to attach and mount various elements, this invention also contemplates the use of various attachment techniques such as welding, riveting and pressing.

Additionally, it will be appreciated that although in the preferred embodiment stationary axle 50 is mounted upon bearings 52 to facilitate the pivoting of the clevis 58, segment 60, arms 48 and adjustable axle 46, the present invention also contemplates the use of a fixed stationary axle which supports the clevis 58, segment 60, arms 48 and adjustable axle 46 for pivoting by use, for example, of a sleeve which pivots on the stationary axle and connects the clevis 58 and the arms 48.

Although the invention has been shown and described with respect to a certain preferred embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A portable rotary power saw for cutting a groove into concrete, asphalt or similar surfaces comprising a housing having a fore end and an aft end, said housing at its aft end having one or more rear wheels supporting said aft end upon such surface and a handlebar assembly extending vertically upward therefrom, said housing at its fore end supporting a rotary cutting blade, a vertically adjustable axle in the proximity of said fore end including one or more front wheels, a stationary axle mounted on said housing between said aft end and said fore end, said adjustable axle being supported by said stationary axle, and adjustment means for adjusting the position of said adjustable axle relative to said housing and in turn the vertical height of said fore end of said housing and thus the cutting depth of said blade, said adjustment means comprising a segment, a latch, and actuation means for operating said latch, said segment having a first leg supported by said stationary axle and a second leg having a plurality of notches spaced along its length and extending through the top of said housing, said latch being located immediately adjacent said notched second leg and being capable of pivoting in and out of engagement with said notches, said segment being connected to said adjustable axle and being biased by a biasing means such that when a user activates said actuation means and exerts a vertically downward force upon said handlebar assembly causing said housing to pivot upon said rear wheels said adjustable axle extends vertically downward relative to said housing and when said user discontinues activating said actuation means said latch engages one of said notches of said second leg of said segment thereby locking said segment and said adjustable axle into a predetermined position.

2. A portable rotary power saw as set forth in claim 1 wherein said segment is L-shape.

3. A portable rotary power saw as set forth in claim 2 wherein said notched second leg is curved and forms an arc throughout its length.

4. A portable rotary power saw as set forth in claim 3 wherein said handlebar assembly includes one or more handgrips for supporting the hands of a user and said actuation means includes a cable assembly having a cable connected to said latch, a controller for moving said cable and a spring for biasing said latch towards engagement with said notches of said second leg of said segment.

5. A portable rotary power saw as set forth in claim 4 wherein said controller comprises a lever mounted in the immediate proximity of one of said handgrips so as to allow a user to manipulate said controller while said user's hands remain on said handgrips.

6. A portable rotary power saw as set forth in claim 5 including a power source for driving said rotary cutting blade.

7. A portable rotary power saw as set forth in claim 6 wherein said power source comprises an internal combustion engine.

8. A portable rotary power saw as set forth in claim 7 wherein said rear wheels are mounted upon said housing ahead of the center of gravity of said internal combustion engine.

9. A portable rotary power saw as set forth in claim 8 wherein said stationary axle is capable of pivoting and is mounted within the housing in the proximity of the center of gravity of said internal combustion engine.

10. A portable rotary power saw as set forth in claim 9 wherein said adjustable axle is connected to said stationary axle by a pair of arms which are attached to said stationary axle and said first leg is attached to said stationary axle utilizing a clevis.

11. A portable rotary power saw as set forth in claim 10 wherein said adjustable axle is located beyond the center of gravity of said internal combustion engine.

12. A portable rotary power saw as set forth in claim 11 wherein said segment is biased by one or more springs which cause said adjustable axle to extend vertically downward relative to said housing when said user activates said actuation means and exerts a vertically downward force upon said handlebar.

13. A power saw for cutting a groove into a surface comprising a housing having a fore end and an aft end, said housing at its aft end having one or more rear wheels supporting said aft end upon such surface and a handlebar assembly extending vertically upward therefrom, said handlebar assembly having one or more handgrips for supporting a users hands, said housing at its fore end supporting a cutting blade, an adjustable axle in the proximity of said fore end including one or more front wheels, a stationary axle mounted within said housing between said aft end and said fore end, and adjustment means for adjusting the vertical position of said adjustable axle relative to said housing said adjustment means comprising a segment, a latch, and actuation means for pivoting said latch, said segment having a first leg supported by said stationary axle and a second leg having a plurality of notches spaced along its length and extending through said housing, said latch being located immediately adjacent said notched second leg of said housing and being capable of pivoting in and out of engagement with said notches, said actuation means comprising a controller connected to said latch and mounted on said handlebar assembly in the immediate proximity of said handgrip such that a user may grasp said lever and pivot said latch out of engagement from said notches while the user's hand remains on said handgrip, said segment being connected to said adjustable axle and being biased by a biasing means such that when a user grasps said controller and exerts a vertically downward force upon said handlebar assembly causing said housing to pivot upon said rear wheels said adjustable axle extends vertically downward relative to said housing and when said user discontinues grasping said controller said latch engages one of said notches of said second leg of said segment thereby locking said segment and said adjustable axle into a predetermined position.

* * * * *